US011053613B1

(12) United States Patent
Huang

(10) Patent No.: US 11,053,613 B1
(45) Date of Patent: Jul. 6, 2021

(54) WOVEN MATERIAL, IN PARTICULAR AN INTERWOVEN MATERIAL

(71) Applicant: Jessica Huang, Flushing, NY (US)

(72) Inventor: Jessica Huang, Flushing, NY (US)

( * ) Notice: Subject to any disclaimer, the term of this patent is extended or adjusted under 35 U.S.C. 154(b) by 0 days.

(21) Appl. No.: 16/847,246

(22) Filed: Apr. 13, 2020

(51) Int. Cl.
*D03D 11/02* (2006.01)
*D03D 1/00* (2006.01)
*A41B 1/08* (2006.01)

(52) U.S. Cl.
CPC ..... *D03D 11/02* (2013.01); *A41B 1/08* (2013.01); *A41B 2500/20* (2013.01)

(58) Field of Classification Search
CPC ..... D03D 11/02; A41B 1/08; A41B 2500/20
See application file for complete search history.

(56) References Cited

U.S. PATENT DOCUMENTS 552,840 A * 1/1896 Johnson ..... B32B 27/12 428/196
1,096,865 A * 5/1914 Samuel ..... E04F 15/10 428/48
1,227,520 A * 5/1917 Angier ..... A41D 27/06 428/190
1,983,617 A * 12/1934 Ladon ..... E04B 1/78 428/141
2,126,711 A * 8/1938 Atwood ..... B32B 27/00 442/60
2,260,052 A * 10/1941 Passavant ..... D03D 11/00 428/102
D133,454 S 8/1942 Tashman
D177,202 S * 3/1956 Wilde ..... D5/47
2,757,436 A * 8/1956 Nicholl ..... D06C 23/00 428/141
D202,020 S 8/1965 Marghab ..... D6/616
3,445,055 A * 5/1969 Port ..... B65D 29/00 383/32
3,949,111 A * 4/1976 Pelletier ..... B29C 65/04 428/109
4,097,631 A * 6/1978 Wilken ..... A41D 31/00 139/420 C
4,646,666 A * 3/1987 Burrier ..... D05B 97/12 112/420
4,696,853 A * 9/1987 Fourezon ..... D04H 3/005 442/187
5,164,250 A * 11/1992 Paz Rodriguez ..... D03D 19/00 442/186
5,288,545 A * 2/1994 De Decker ..... D03D 15/46 442/185
D415,792 S 10/1999 Oren ..... D19/1
D430,971 S * 9/2000 Harvey ..... D3/232
D470,705 S * 2/2003 Tweel ..... D6/616
(Continued)

*Primary Examiner* — Robert H Muromoto, Jr.
(74) *Attorney, Agent, or Firm* — Shlesinger, Arkwright & Garvey LLP

(57) ABSTRACT

An interwoven material. More particularly, the interwoven material includes a first fabric and a second fabric. The first and second fabric are interwoven. The interwoven material includes a first column of interwoven material, a second column of interwoven material, and a third column of interwoven material. Also, there is a first row of interwoven material, a second row of interwoven material, and a third row of interwoven material. The second fabric is under the first fabric in the first row in the first columns; and the second fabric is over the first fabric in the first row in the second column.

10 Claims, 4 Drawing Sheets

(56) References Cited

U.S. PATENT DOCUMENTS 6,539,983 B2 * 4/2003 Khokar ..... D03D 15/44 139/383 A
D506,099 S 6/2005 Muse ..... D6/608
6,904,855 B2 * 6/2005 Xu ..... D05B 97/00 112/117
D526,485 S * 8/2006 Harvey ..... D3/246
D532,604 S * 11/2006 Harvey ..... D3/246
D548,459 S * 8/2007 Harvey ..... D3/246
7,264,023 B2 * 9/2007 Jackson ..... D03D 15/00 139/420 R
D559,538 S * 1/2008 Dew ..... D3/232
D560,353 S * 1/2008 Harvey ..... D3/217
D561,467 S * 2/2008 Maier ..... D3/232
D581,158 S * 11/2008 Hermann ..... D3/232
D581,659 S * 12/2008 Sassi ..... D3/232
D582,671 S * 12/2008 Harvey ..... D3/245
D607,214 S * 1/2010 Brooks ..... D5/59
D624,311 S 9/2010 Krakoff ..... D3/232
D637,033 S 5/2011 Passariello ..... D6/608
D646,789 S 10/2011 Barth ..... E04G 21/30 D24/189
D654,600 S 2/2012 Devine ..... E04G 21/30 D25/138
D669,292 S * 10/2012 Mekpongsatorn ..... D6/613
D673,802 S 1/2013 Wilson ..... D6/608
D679,333 S 4/2013 Jabara ..... D20/27
D685,195 S * 7/2013 Maier ..... D5/58
8,769,743 B2 * 7/2014 Sanders ..... A47C 27/007 5/502
D717,039 S 11/2014 Sassi ..... D3/232
D726,420 S * 4/2015 Cordovana ..... D5/99
D727,429 S 4/2015 Boyer ..... D20/27
D739,641 S * 9/2015 Angeletti ..... D2/600
D769,615 S 10/2016 Sassi ..... D3/232
D770,813 S 11/2016 Furstenburg ..... D6/608
D785,323 S 5/2017 Maier
D803,418 S 11/2017 Annibale ..... D25/58
D824,181 S 7/2018 Rivetti
D831,388 S 10/2018 Rus ..... D6/610
D834,815 S 12/2018 Barlier ..... D3/246
D847,539 S 5/2019 Rus ..... D6/610
D854,827 S * 7/2019 Yuan ..... D3/289
D862,071 S 10/2019 Winters Giesting ..... D3/232
D874,824 S 2/2020 Cardis ..... D3/299
D889,141 S 7/2020 Anderson ..... G01V 8/10 D5/99
D899,793 S * 10/2020 Huang ..... D5/99
D908,350 S * 1/2021 Huang ..... D3/246
2008/0041150 A1 2/2008 Lohr ..... G01V 8/10 73/159
2014/0004296 A1 * 1/2014 Khokar ..... B29C 70/22 428/104
2014/0224391 A1 8/2014 Muxlow ..... 150/154
2017/0183883 A1 6/2017 Rus ..... E04G 21/30
2017/0183884 A1 6/2017 Rus ..... E05G 21/30

* cited by examiner

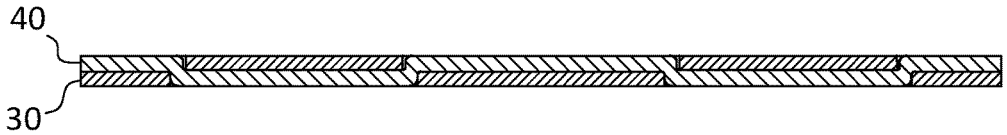
FIG. 3
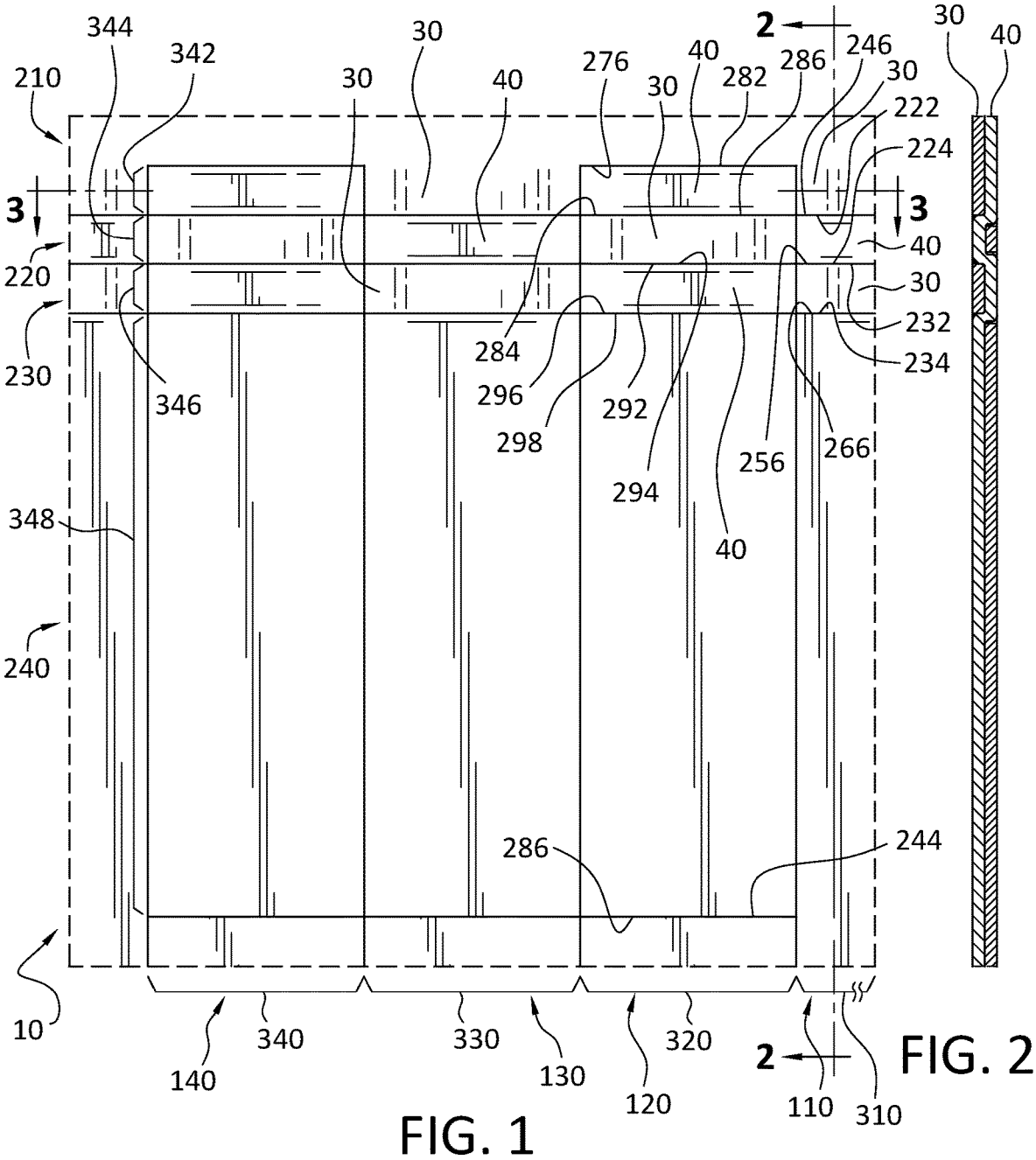
FIG. 2
FIG. 1

WOVEN MATERIAL, IN PARTICULAR AN INTERWOVEN MATERIAL

FIELD OF THE INVENTION

The present invention relates to a woven material. More particularly, the invention relates to an interwoven material.

SUMMARY OF THE INVENTION

The present invention relates to a woven material. More particularly, the invention relates to an interwoven material including a first fabric and an interwoven second fabric forming the interwoven material.

The invention further includes an interwoven material including a first fabric, and a second fabric. The first fabric and the second fabric being interwoven and forming the interwoven material. A first column of the interwoven is provided, a second column of the interwoven material and a third column of the interwoven material are provided. There are likewise a first row of the interwoven material having a top and a bottom, a second row of the interwoven material having a top and a bottom, and third row of the interwoven material having a top and a bottom.

Further, an opening is provided at the bottom of the first row in the first column, an opening is provided at the bottom of the second row in the first column, and an opening is provided at the bottom of the third row in the first column.

Likewise, the second fabric is under the first fabric in the first row in the first column, the second fabric is over the first fabric in the first row in the second column, and the second fabric is under the first fabric in the first row in the third column.

The invention further includes the material set forth below.

Relative terms such as left, right, up, down, top and bottom are for convenience only and are not intended to be limiting.

BRIEF DESCRIPTION OF THE DRAWINGS

FIG. 1 is a plan view of an embodiment of an interwoven material according to the invention;

FIG. 2 is a sectional view of the interwoven material taken along line 2-2 in FIG. 1;

FIG. 3 is a sectional view of the interwoven material taken along line 3-3 in FIG. 1;

DETAILED DESCRIPTION OF THE INVENTION

Figure 4:
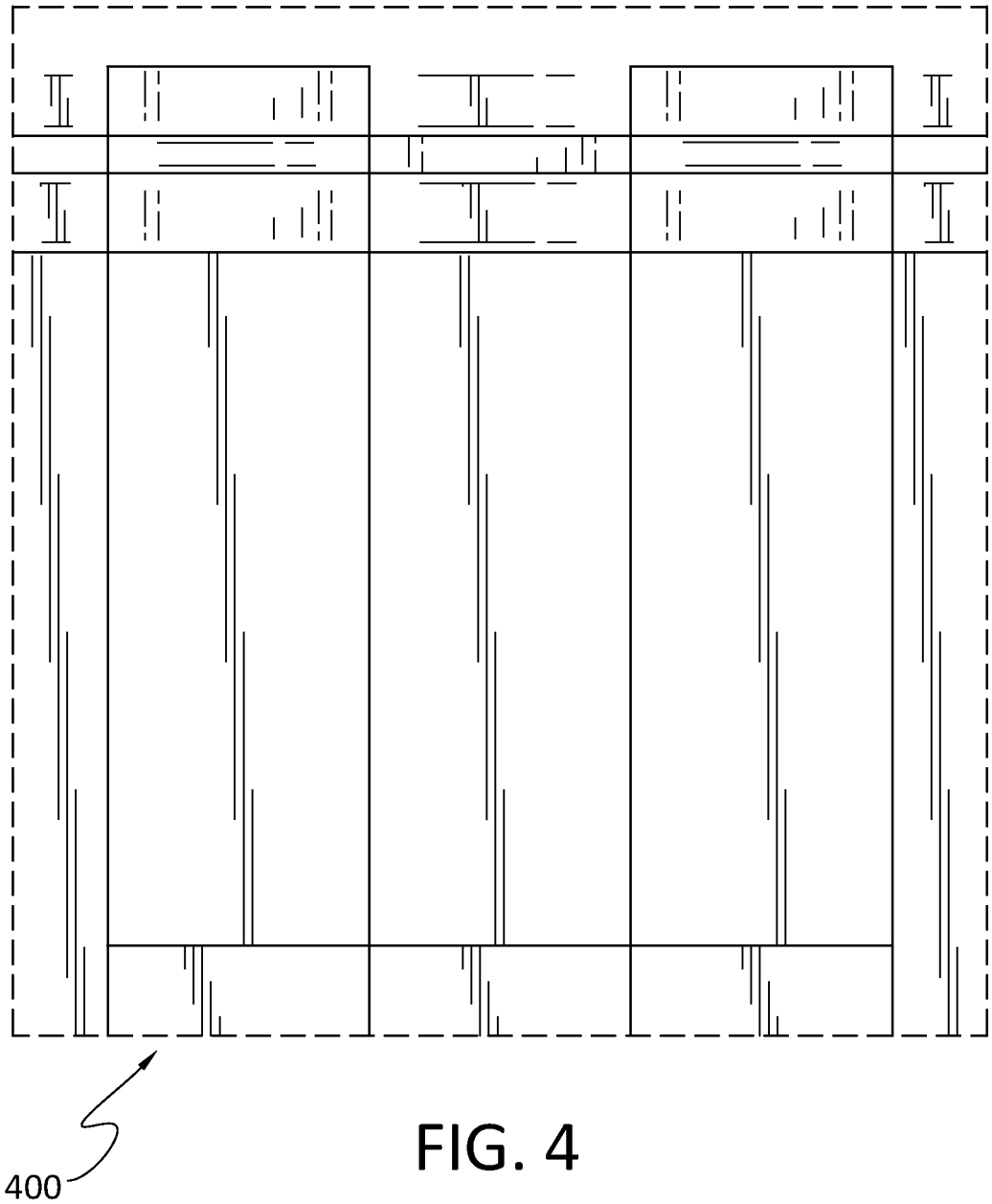
FIG. 4 is a rear plan view of the interwoven fabric material of FIG. 1.

FIGS. 1-4 show an interwoven material 10 according to the invention.

Interwoven material 10 may include a first fabric 30 and a second fabric 40.

First fabric 30 and second fabric 40 may be interwoven and form interwoven material 10.

A first column 110 of the interwoven material 10, a second column 120 of the interwoven material, a third column 130 of interwoven material, and a fourth column 140 of interwoven material 10 may be provided. A first row 210 of the interwoven material having a top (not shown for ease of understanding) and a bottom 114, a second row 220 of the interwoven material having a top 222 and a bottom 224, and third row 230 of the interwoven material having a top 232 and a bottom 234 may likewise be provided.

A fourth row 240 having a top 242 and a bottom 244 may be provided.

An opening 246 may be provided at the bottom 114 of the first row 210 in the first column 110. An opening 256 may be provided at the bottom 224 of the second row 220 in the first column 110, and an opening 266 may be provided at the bottom 234 of the third row in the first column 110.

Fourth row 240 may have an opening 276 at top 242 and an opening 286 at bottom 244 may be provided, as shown in column 120 for ease of understanding.

Second fabric 40 may be under the first fabric 30 in the first row in the first column; and the second fabric 40 may be over the first fabric in the first row 210 in the second column 120.

Second fabric 40 may be under first fabric 30 in the first row 210 in the third column 130.

Second fabric 40 may be over first fabric 30 in the second row 220 in the first column 110.

Second fabric 40 may be under first fabric 30 in the third row 230 in the first column 110.

Second fabric 40 may be under first fabric 30 in the second row 220 in the second column 120.

Interwoven material 10 may have an opening 276 provided at a top 282 and an opening 284 provided at a bottom of the first row in the second column.

An opening 292 may be provided at a bottom 294 of the second row in the second column 120; and an opening 296 may be provided at a bottom 298 of third row 230 in the second column 120.

Second fabric 40 may be over first fabric 30 in the first row 210 in the second column 120; and second fabric 40 may be under the first fabric 30 in the second row 220 in the second column 120.

Second fabric 40 may be over first fabric 30 in the third row 230 in the first column 110.

Interwoven material 10 may include that first column 110, second column 120, and third column 130 have respective widths 310, 320, and 330; and the respective widths 310, 320, and 330 are substantially the same. There may likewise be a fourth column 140 of material having a fourth width 340.

Interwoven material may include that first row 210, second row 220, and third row 230 have respective heights 342, 344, and 346; and the respective heights 342, 344, and 346 are substantially the same.

The interwoven material 10 may have a fourth row 240 of interwoven material; and fourth row 240 has a height 348, and height 348 of fourth row 240 is greater than the respective heights 342, 344, and 346 of the first row, the second row, and the third row.

Interwoven material 10 may include that second fabric 40 is adjacent first fabric 30. Second fabric 40 may be adjacent first fabric 40, and may be directly adjacent first fabric 30.

FIG. 4 is a rear plan view of a rear 400 of interwoven material 10 of FIG. 1.

Figure 7:
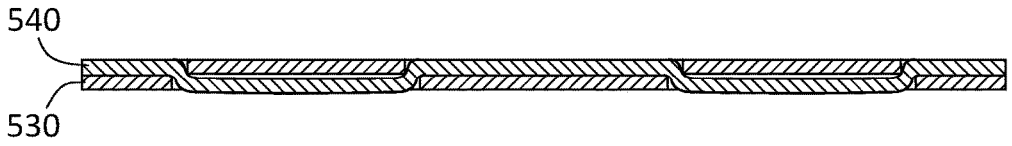
FIG. 7 is a sectional view of the interwoven material taken along line in FIG. 5.
Figure 5:
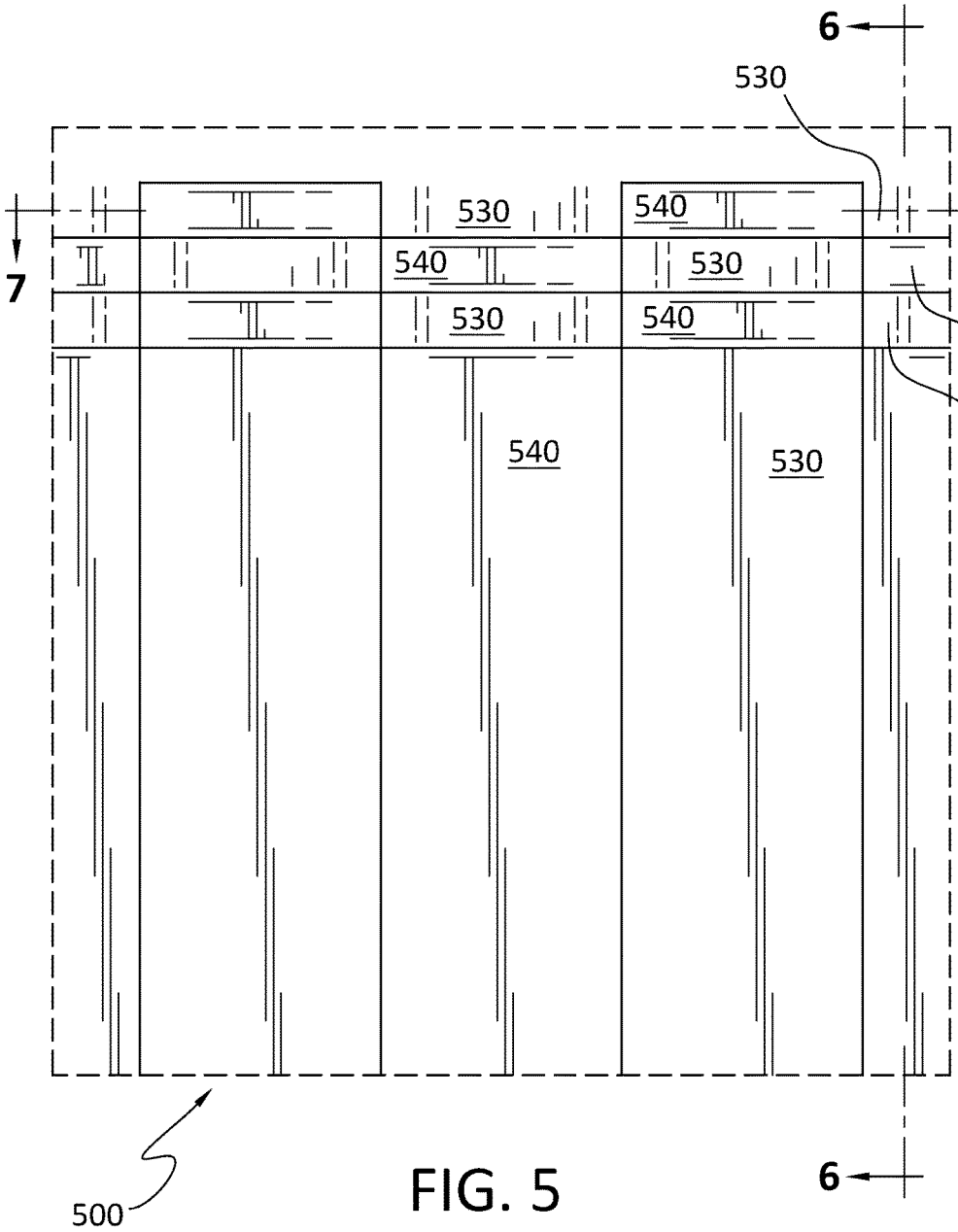
FIG. 5 is a plan view of an embodiment of an interwoven material according to the invention.
Figure 6:
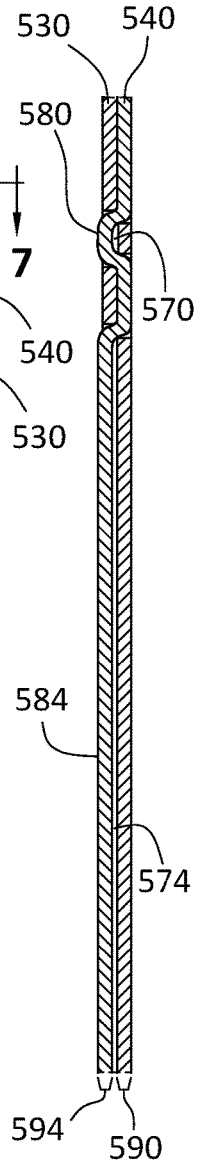
FIG. 6 is a sectional view of the interwoven material taken along line 6-6 in FIG. 5.

FIGS. 5-7 show an interwoven material 500 according to an embodiment of the invention.

Interwoven material 500 may include a first fabric 530 and a second fabric 540.

First fabric 530 and second fabric 540 may be interwoven and form interwoven material 500.

It will be appreciated that additional first fabric 530 and second fabric material 540 may be provided, if required, to provide for respective gaps 570 and 574, and extensions 580 and 584.

Interwoven material 500 may include that second fabric 540 is adjacent first fabric 530, Second fabric 540 may be in part spaced apart from first fabric 530 and provide one or more gaps 570 and 574 between the second fabric 540 and first fabric 530.

Gaps 570 and 574 may provide outward extensions 580 and 584 where second fabric 540 extends away from first fabric 530. Outward extensions 580 and 584 may be best seen and understood from FIG. 6 showing section 6-6. As will be understood and appreciated by a person having ordinary skill in the art, such gaps 570 and 574 and respective outward extensions 580 and 584 may increase the utility of interwoven material 500.

A thickness (e.g., size) of gaps 570 and 574 and respective extensions 580 and 580 may be less than, equal to, or greater than a thickness 590 of first fabric 530 and a thickness 594 of second fabric 540; the thickness of gaps 570 and 574 may be 5, 10, 20 or more times greater than the respective thicknesses 590 and 594 of one or both of first fabric 530 and second fabric 540.

It will be appreciated that additional first fabric 530 and second fabric 540 may be provided, if required, to provide for respective gaps 570 and 574, and extensions 580 and 584.

Second fabric 540 may have one of the gaps and extensions in the second row in the first column. Second fabric may have one of the gaps and extension in the first row in the second column. Further, second fabric 540 may have one of the gaps 570 and 574 and extensions 580 and 584 in the third row in the second column. Second fabric may have one of gaps 570 and 574 and extensions 580 and 584 in in the second row 220 in third column 130.

Figure 8:
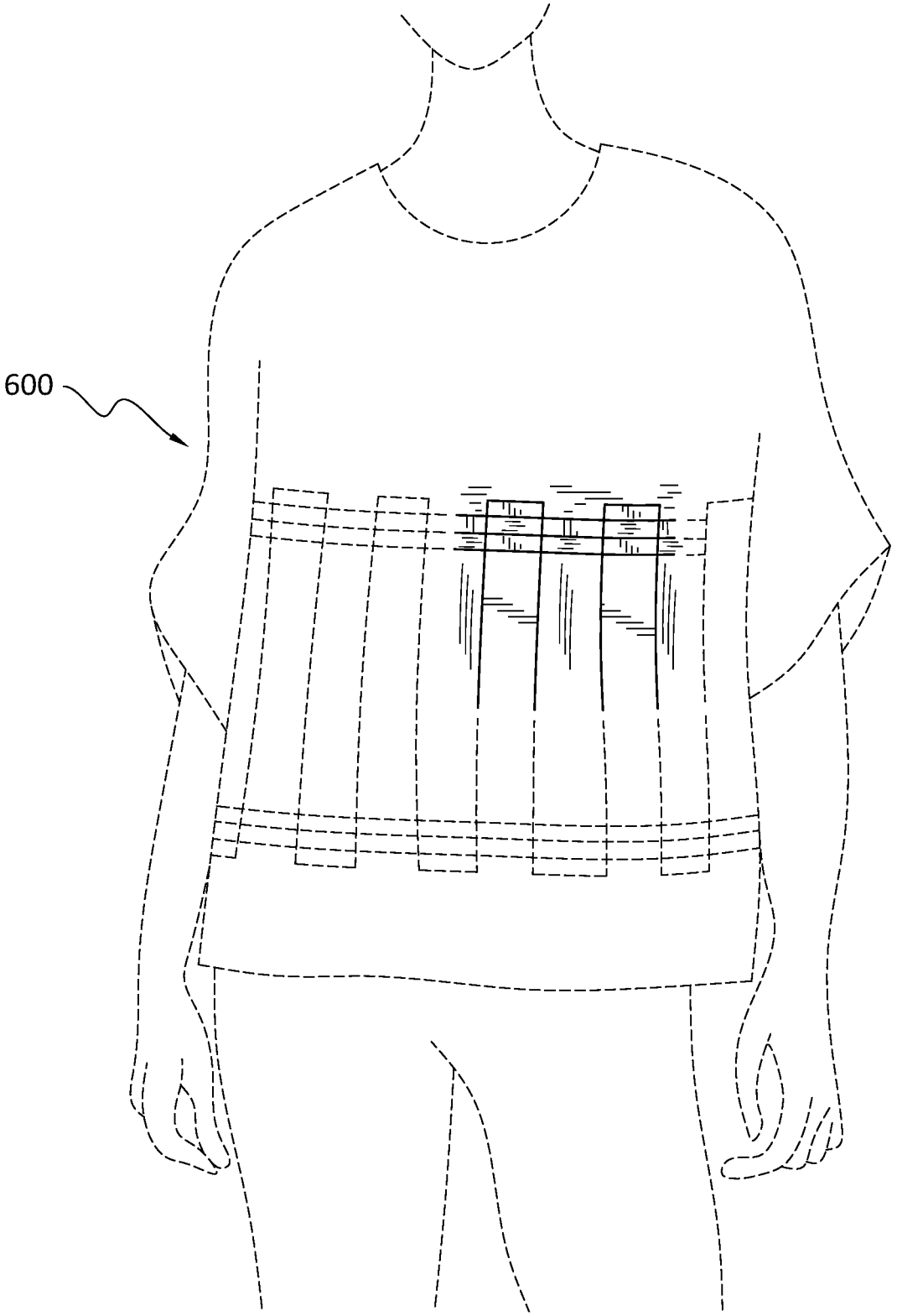
FIG. 8 is a view of an interwoven material according to the invention shown in use as an article of clothing.

FIG. 8 is a view of an interwoven material according to the invention shown in use as an article of clothing 600.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention.

What is claimed is:

1. An interwoven material, the interwoven material comprising:

a) a first fabric, and a second fabric;

b) the first fabric and the second fabric being interwoven and forming the interwoven material;

a) a first column of the interwoven material, a second column of the interwoven material, and a third column of the interwoven material;

b) a first row of the interwoven material having a top and a bottom, a second row of the interwoven material having a top and a bottom, and third row of the interwoven material having a top and a bottom;

e) an opening is provided at the bottom of the first row in the first column;

f) an opening is provided at the bottom of the second row in the first column;

g) an opening is provided at the bottom of the third row in the first column;

h) the second fabric being under the first fabric in the first row in the first column;

i) the second fabric being over the first fabric in the first row in the second column;

j) the second fabric being under the first fabric in the first row in the third column; and k) the second fabric is in part spaced apart from the first fabric and provides gaps and extensions.

2. The interwoven material as in claim 1, wherein:

a) the second fabric has one of the gaps and extensions in the second row in the first column.

3. The interwoven material as in claim 1, wherein:

a) the second fabric has one of the gaps and extension in the first row in the second column.

4. The interwoven material as in claim 1, wherein:

a) the second fabric has one of the gaps and extensions in in the third row in the second column.

5. The interwoven material as in claim 1, wherein:

a) the second fabric has one of the gaps and extensions in in the second row in the third column.

6. The interwoven material as in claim 1, wherein:

a) the first fabric has a thickness and the second fabric has a thickness; and b) a thickness of the gaps and extensions is greater than the thickness of the first fabric and the second fabric.

7. The interwoven material as in claim 1, wherein:

a) an opening is provided at the top and the bottom of the first row in the second column;

b) an opening is provided at the bottom of the second row in the second column;

c) an opening is provided at the bottom of the third row in the second column;

d) the second fabric being over the first fabric in the first row is the second column;

e) the second fabric being under the first fabric in the second row in the second column; and f) the second fabric being over the first fabric in the third row in the first column.

8. The interwoven material as in claim 1, wherein:

a) the first column, the second column, and the third column have respective widths; and b) the respective widths are substantially the same.

9. The interwoven material as in claim 8, wherein:

a) the first row, the second row, and the third row have respective heights; and b) the respective heights are substantially the same.

10. The interwoven material as in claim 9, wherein:

a) a fourth row of interwoven material is provided; and b) the fourth row has a height, and the height of the fourth row is greater than the respective heights of the first row, the second row, and the third row.

* * * * *